United States Patent [19]

Hiroshi et al.

[11] 4,421,837

[45] Dec. 20, 1983

[54] METHOD OF IMPROVING IMAGE SHARPNESS OF AN ELECTROPHOTOGRAPHIC PHOTOSENSITIVE PLATE

[75] Inventors: Yasuba Hiroshi, Jyoyou; Umeda Masahiro, Moriguchi; Yuri Osamu, Kyoto, all of Japan

[73] Assignee: Matsushita Electric Industrial Co., Ltd., Japan

[21] Appl. No.: 17,534

[22] Filed: Mar. 5, 1979

Related U.S. Application Data

[63] Continuation of Ser. No. 740,723, Nov. 10, 1976, abandoned.

[30] Foreign Application Priority Data

Nov. 12, 1975 [JP] Japan ..... 50-136499

[51] Int. Cl.[3] ..... G03G 13/22

[52] U.S. Cl. ..... 430/31; 430/83

[58] Field of Search ..... 96/1 R, 1 C, 1.6; 355/3 CH; 430/130, 83, 31

[56] References Cited

U.S. PATENT DOCUMENTS

| | | | |
|---|---|---|---|
| 3,481,669 | 12/1969 | Roth et al. | 355/3 |
| 3,533,783 | 10/1970 | Robinson | 96/1 R |
| 3,558,307 | 1/1971 | Carlson | 96/1 R |
| 4,042,388 | 8/1977 | Inoue et al. | 430/83 |

*Primary Examiner*—John E. Kittle
*Assistant Examiner*—John L. Goodrow
*Attorney, Agent, or Firm*—Wenderoth, Lind & Ponack

[57] ABSTRACT

A method of improving image sharpness or image resolution on a dye sensitized electrophotographic photosensitive plate to be negatively charged before image light exposure and with use of positively charged toners, the method comprising applying ultraviolet light to the surface of the dye-sensitized photoconductive layer of the plate before the negative charging. Thereby, it becomes possible to use positively charged toners with excellent resultant image sharpness or resolution.

7 Claims, 5 Drawing Figures

METHOD OF IMPROVING IMAGE SHARPNESS OF AN ELECTROPHOTOGRAPHIC PHOTOSENSITIVE PLATE

This is a continuation of application Ser. No. 740,723, filed Nov. 10, 1976, now abandoned.

This invention relates to a method of improving image sharpness of an electrophotographic photosensitive plate, particularly of a dye-sensitized electrophotographic photosensitive plate to be negatively charged before image light exposure and with positively charged toners.

It is known that images may be formed and developed by an electrophotographic process on the surface of an electrophotographic photosensitive plate which is an electrically conductive layer having thereon a photosensitized photoconductive layer. A basic electrophotographic process comprises applying a uniform charge to the surface of the photoconductive layer of the plate, exposing the thus charged photoconductive layer to an image light to form a latent image, and applying, to the thus light exposed photoconductive layer, a toner charged with a polarity opposite to that of the uniform chage. Thereby, a visible toner image is developed on the plate.

In the case of a dye-sensitized electrophotographic photosensitive plate for a slide (transparency) or microfilm using polyvinylcarbazole or its derivative as a photoconductor and a dye as a photosensitizer, the polarity of the uniform charging is usually chosen to be positive and the charge polarity of the toner is negative. This is because if these polarities are respectively reversed, an image of high sharpness or high resolution cannot be obtained. However, there are good quality toners available which can effectively be charged only positively. It is sometimes very much desired to use such toners for their unique colors, for example. However, since the use of such toners causes the resultant image to have low sharpness or low resolution as described above, it is not advantageous according to prior art to use such toners.

It is an object of this invention to provide a method of improving image sharpness or resolution of an electrophotographic photosensitive plate comprising an electrically conductive layer having thereon a photoconductive layer which uses an organic polymer or polymers as a photoconductor and a dye as a photosensitizer and which is to be negatively charged in the uniform charging, so as to make it possible to use positively charged toners with high image sharpness or resolution of resultant toner images.

This object is achieved according to this invention by applying an ultraviolet light onto the surface of the dye-sensitized photoconductive layer of the electrophotographic photosensitive plate before the uniform negative charging.

This and other objects and features of this invention will be apparent upon consideration of the following detailed description taken together with the accompanying drawings, in which.

Figure 1:
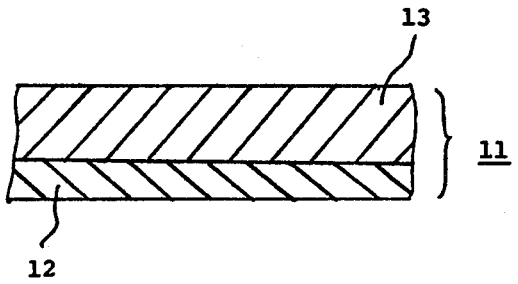
FIG. 1 is a schematic cross-sectional view of an electrophotographic photosensitive plate.

Referring to FIG. 1, reference numeral 11 designates an electrophotographic photosensitive plate which comprises an electrically conductive layer (base) 12 and a dye-sensitized photoconductive layer 13. Layer 13 comprises, as preferred material, a polyvinylcarbazole or its derivative, as a photoconductor, having dispersed therein one or more dye sensitizers. The photoconductive layer 13 can further have dispersed therein one inactive additive or more inactive additives such as a plasticizer and a mechanical strength enhancer. A preferred thickness of the photoconductive layer 13 is between 5 and 50 microns, more preferably between 10 and 20 microns.

The polyvinylcarbazole or a polyvinylcarbazole derivative referred to herein is a polymer of vinylcarbazole or its derivative, or a copolymer of N-vinylcarbazole or its derivative and another vinyl compound such as vinylacetate and methylmethaacrylate. The derivative referred to herein has e.g. a substituent such as a halogen atom, nitro radical, alkyl radical, aryl radical, alkyl aryl radical, amino radical and alkylamino radical, in place of the hydrogen atom in the carbazole ring in the recurring unit of the above described polymers. The number and the position of the substituents in the carbazole ring and the polymerization degree of the resultant polymer are determined by their preparation and are not limited to those expressly disclosed herein. A preferred polyvinylcarbazole is poly-N-vinylcarbazole and preferred polyvinylcarbazole derivatives are brominated poly-N-vinylcarbazole and chlorinated poly-N-vinylcarbazole.

The dye sensitizers photosensitize an organic photoconductor such as polyvinylcarbazole and its derivatives, and include, as preferred ones, benzopyrylium salts, benzothiopyrylium salts, pyrylium salts, thiopyrylium salts, substituted benzopyrylium salts, substituted benzothiopyrylium salts, substituted pyrylium salts, substituted thiopyrylium salts, quinone derivatives such as chloranil, anthraquinone, triphenylmethane dyes such as malachite green, crystal violet, and fluorenone derivatives such as 2, 4, 7-trinitrofluorenone. More preferred dye sensitizers are benzopyrylium salts, benzothiopyrylium salts, pyrylium salts, thiopyrylium salts, substituted benzopyrylium salts, substituted benzothiopyrylium salts, substituted pyrylium salts and substituted thiopyrylium salts. The dye sensitizer or sensitizers are preferably uniformly dispersed in the photoconductor. However, the uniformity of the dye dispersion is not necessarily extremely high. However, it is not preferred that the dye sensitizer or sensitizers be localized at the surface of the photoconductive layer 13 upon which surface an ultraviolet light is to be applied. The weight ratio, of the dye sensitizer or sensitizers to the photoconductor is preferably between 0.05:100 and 5:100. Too large an amount of the dye sensitizer or sensitizers causes much dark decay. Too small an amount of the dye sensitizer or sensitizers causes the photosensitivity of the photoconductive layer to become insufficient, and undesirably necessitates a very strong light image exposure or a very long light image exposure time.

The inactive additive or additives which can be uniformly dispersed in the photoconductor include plasticizers such as an epoxy resin, chlorinated fatty acid ester and ortho-terphenyl, and mechanical strength enhancers such as a polycarbonate resin. A preferred weight ratio, of the photoconductor to the inactive additive or additives, if used, is between 100:10 and 100:100. Too large an amount of the inactive additive or additives deteriorates the photosensitivity of the photoconductive layer. Too small an amount of the inactive additive or additives does not produce the intended effect.

The electrically conductive layer 12 can be made of any available and suitable conductive materials such as CuI, $In_2O_3$, $SnO_2$ and palladium. When the electrophotographic photosensitive plate is used for a slide (transparency), the conductive layer 12 should be transparent.

The electrophotographic photosensitive plate can be made by a per se well known manner as follows. An electrically conductive material is deposited by a per se well known manner on an insulating substrate such as polyester film and glass to form the electrically conductive layer 12. On the thus formed conductive layer 12 is applied an organic solution comprising an available and suitable organic solvent having dissolved therein one of the above described photoconductors and one or more of the above described dye sensitizers, and further, if necessary, one or more of the above described inactive additives. If necessary, an available and suitable adhesive material, as an adhesive layer, can be applied on the electrically conductive layer 12 before the application of the organic solution. The thus applied organic solution, after being dried, forms the dye-sensitized photoconductive layer 13. The time necessary for drying the organic solution is usually about one hour e.g. at 70° C. or one day at room temperature.

Now, for forming a visible image on the surface of the electrophotographic photosensitive plate 11, the plate is subjected to an electrophotographic process comprising applying a uniform charge of one polarity on the surface of the photoconductive layer 13 by a per se well known means such as a corona discharger, subjecting the thus charged photoconductive surface to a light image such as a light reflected from an original to be image-recorded to form a latent image (charge image) on the photoconductive surface, and applying on the thus treated photoconductive surface a toner (black or colored) having a charge the polarity of which is opposite to that of the uniform charge, so as to form a visible image (toner image) on the photoconductive surface. The toner can be applied in a per se well known manner, e.g. by using a toner liquid comprising a suspending liquid such as an isoparaffinic hydrocarbon having dispersed therein charged toner pigments such as carbon, phthalocyanine blue, has a yellow and fanal rose.

When the first uniform charge has a positive polarity and hence the toner pigments are negatively charged, the resultant toner image has considerably high image sharpness or resolution. However, when the first uniform charge has a negative polarity and hence the toner pigments are positively charged, the resultant toner image has a low image sharpness or resolution.

It is the discovery on which this invention is based that when a uniform ultraviolet light is applied to the surface of the photoconductive layer 13 before the first uniform charging, the resultant toner image can have a very high image sharpness or resolution even in the case of using the first uniform charging of negative polarity and positively charged toner pigments. There is a preferred range of the amount or strength of the ultraviolet light to be applied to the photoconductive layer, depending on the type of photoconductive layer (e.g. amount of dye-sensitizers, etc.). For example, it is apparent that too small an amount or too low a strength of the ultraviolet light is not effective for improving the resultant toner image sharpness or resolution. And too large an amount or too high a strength of the ultraviolet light may damage the photosensitivity of the photoconductive layer. But since it is very difficult to give numerical definition of the preferred amount or strength range of the ultravoilet light, which definition can be applied to any kind of photoconductive layer, such definition is not made herein. However, this invention is not indefinite due to the undefined amount or strength of the ultraviolet light, because it is very easy for one of ordinary skill in the art to find a proper amount or strength of the ultraviolet light, once the type of the photoconductive layer is determined.

The effect of improving the image sharpness or resolution obtained by this invention is presumed to be based on the following mechanism. When a portion of the photoconductive layer is struck by a light incident perpendicularly to the surface of the photoconductive layer after the uniform negative charge is applied on whole the surface of the photoconductive layer, holes of hole-electron pairs generated by the light at the dispersed dye-sensitizers in the photoconductive layer corresponding to the light struck surface are attracted by and move towards the negative charges positioned on the light struck surface of the photoconductive layer since in polyvinylcarbazole or its derivative, holes are main carriers, and electrons are not. The thus attracted holes and the negative charges on the light struck surface cancel each other so that the negative charges remain only on the light non-struck surface. However, strictly speaking, the holes of hole-electron pairs generated by the light at the dispersed dye-sensitizers at the light struck surface or at very shallow positions under the light struck surface and very near the border line between the light struck and the light non-struck surfaces are also attracted by and move to the negative charges on the light non-struck surface very near the border line between the light struck and the light non-struck surfaces as leakage holes. The thus attracted holes and the negative charges on the light non-struck surface near the border line between the light struck and the light non-struck surfaces cancel each other. The uniform ultraviolet light applied to the surface of the photoconductive layer before the uniform charge application, is presumed to cause the dye-sensitizers at the surface and near the surface of the photoconductive layer to lose their photosensitizing function permanently, i.e. to fade, so as to prevent hole-electron pairs from being generated at the surface and near the surface of the photoconductive layer. This is because the ultraviolet light reaches only to a very shallow depth of the photoconductive layer surface, although visible light penetrates all through the photoconductive layer. It is considered that thereby the leakage holes are substantially prevented from occurring. This is presumably the reason for the effect that the image sharpness or resolution are improved according to this invention.

It is preferred that the ultraviolet light application according to this invention be carried out sufficiently prior to, e.g. one week at room temperature or e.g. five hours at 60° C., before the uniform charge application. This is because the applied ultraviolet light not only causes the dye-sensitizers at the surface and near the surface (shallow positions) of the photoconductive layer to lose their photosensitizing function, but also generates trapped carrier at the shallow positions of the photoconductive layer. Further, visible light components possibly included in the ultraviolet light also generate trapped carriers in the photoconductive layer. The existence of the trapped carriers already before the uniform chargings, causes the initial potential of the uniform charge to decrease by the already existing trapped carriers. Thereby, the apparent photosensitivity of the photoconductive layer is decreased. However, if a higher uniform charge is applied to the surface of the photoconductive layer after the ultraviolet light application, so that a sufficiently high potential of the uniform charge can remain on the surface of the photoconductive layer after the decrease of the initial potential of the uniform charge due to the trapped carriers generated by the ultraviolet light, then the uniform charge application can be carried out immediately after the ultraviolet light application without any trouble, i.e. without decreasing the apparent photosensitivity of the photoconductive layer, of course.

Once the ultraviolet light application is carried out to improve the image sharpness or resolution of the electrophotographic photosensitive plate, the improved quality of the plate remains for a long time, and substantially permanently. And if the toner images having high image sharpness or resolution formed on the thus improved plate are wiped off e.g. by using an organic solvent and new toner images are formed on the thus wiped plate (by using negative uniform charging and positively charged toner pigments), the new toner images also have improved high image sharpness or resolution.

Figure 2:
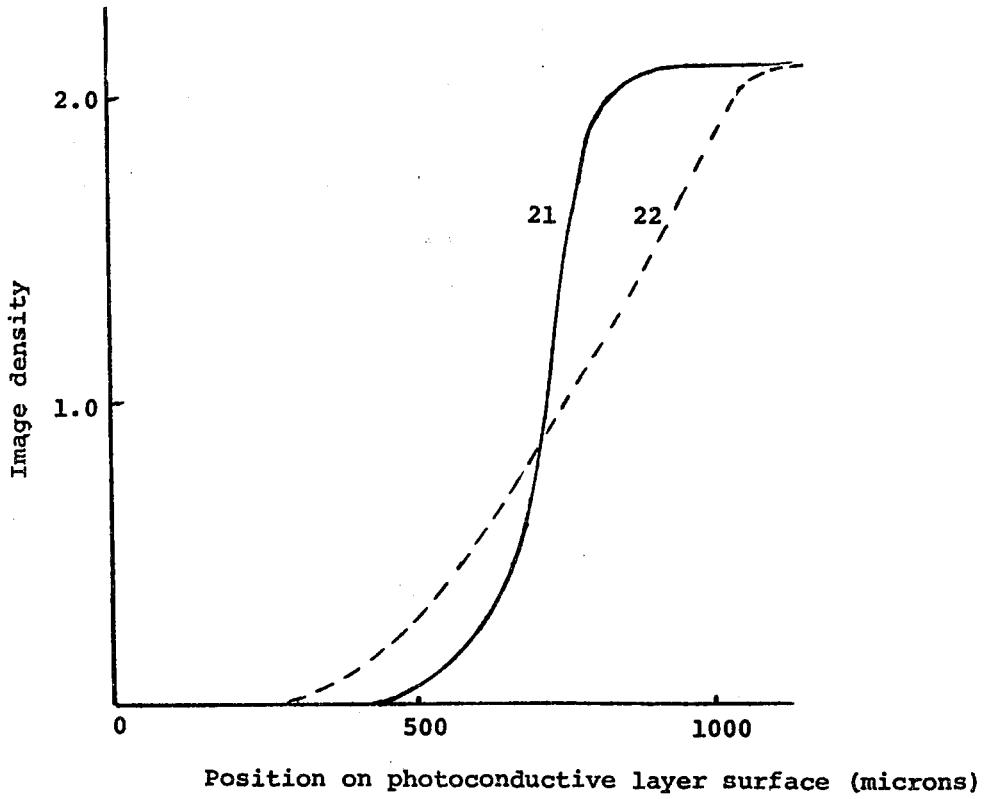
FIG. 2 is a graph showing the relation between the image densities and the positions on the surface of the photoconductive layer of the plate on which the image densities are measured.

FIG. 2 shows the relation between the image densities and the positions on the surface of the photoconductive layer 13 on which the image densities are measured after a toner image is developed, wherein the solid curve 21 represents the case of this invention (using the ultraviolet light) and the dotted curve 22 represents the case of prior art (not using the ultraviolet light), both of which are obtained by using the same negative uniform charging and the same positively charged toner. The positions on the surface of the photoconductive layer mean positions on a straight line drawn on the surface of the photoconductive layer in perpendicular to the border line between the image light struck area and the image light non-struck area, the starting point of the straight line being on the image light struck area and being designated in FIG. 2 as 0 micron. It is apparent that the curve 21 represents a higher image sharpness or resolution than in the case of the curve 22.

Figure 3:
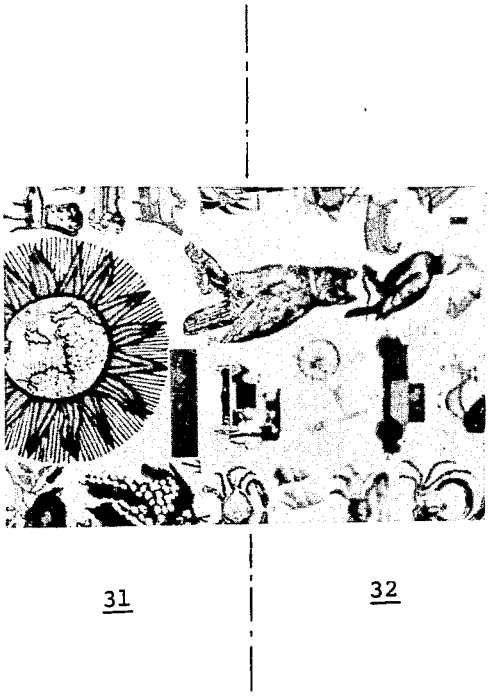
FIG. 3 is a photograph showing the effect of the ultraviolet light application according to this invention.

FIG. 3 is an exemplary photograph showing the effect of the ultraviolet light application according to this invention. This photograph shows an example of resultant toner images formed on the photoconductive layer 13 by using a negative uniform charging and positively charged toner after a uniform ultraviolet light application was applied to a half portion of the surface of the photoconductive layer 13, wherein 31 designates the ultraviolet light applied portion and 32 designates the ultraviolet light non-applied portion. The thus ultraviolet light applied plate was kept in the dark for one year. It is apparent from FIG. 3 that the ultraviolet light application contributes to a great improvement of the image sharpness or resolution of the electrophotographic photosensitive plate, and the effect of the ultraviolet light application can be maintained for a long time.

Figure 4:
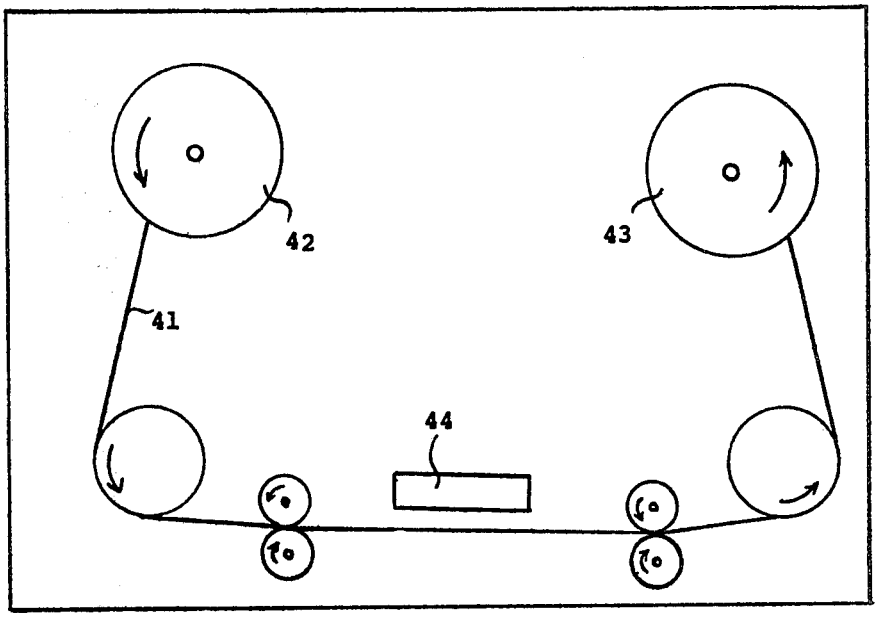
FIG. 4 is a schematic diagram of an apparatus for continuously applying the ultraviolet light to the photoconductive layer of the plate in the form of a long roll film.

FIG. 4 shows an example of a schematic diagram of an apparatus which can be used for continuously applying the ultraviolet light to the photoconductive layer of the electrophotographic photosensitive plate in the form of a long roll of film. Reference numeral 42 designates a supply roller which has a wound roll of film 41 of the electrophotographic photosensitive plate and from which the film 41 is unwound to be fed through various rollers (as shown) to a winding roller 43 which winds the fed film 41. An ultraviolet light generator 44 such as a mercury lamp is provided near the film path, as shown, so as to face the photoconductive layer of the film 41 to apply a constant uniform ultraviolet light onto the photoconductive layer of the film 41. The ultraviolet light generator 44 forms a constant ultraviolet light exposure zone on the film path. By varying the rotational speeds of the supply roller 42 and the winding roller 43, the amount of the ultraviolet light applied to the surface of the photoconductive layer of the film 41 can be varied.

Figure 5:
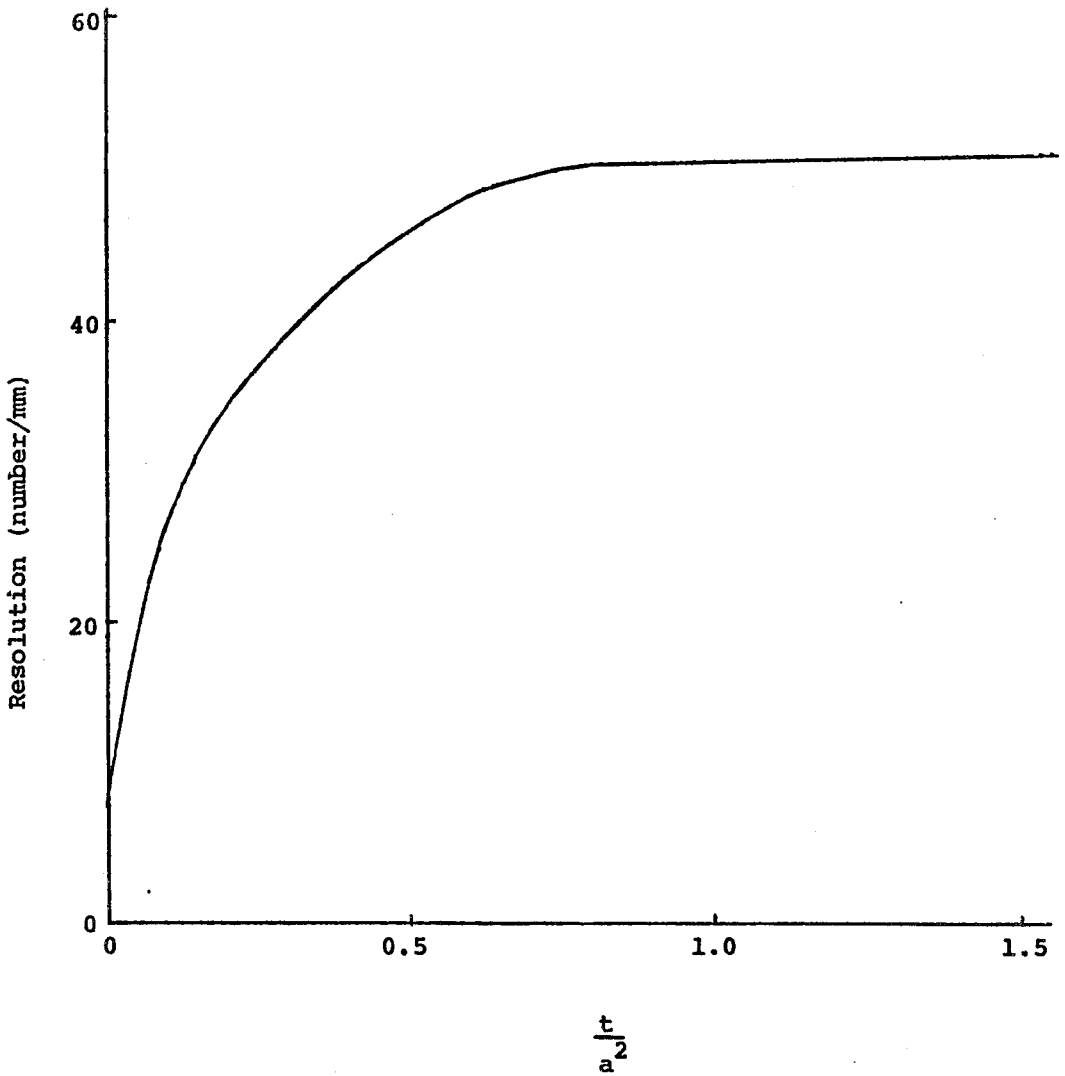
FIG. 5 is a graph showing an example of the relation between the image resolution and the amount of ultraviolet light irradiated from an ultraviolet light generator.

FIG. 5 shows an example of the relation between the image resolution and the amount ($t/a^2$) of the ultraviolet light irradiated from the ultraviolet light generator 44 of FIG. 4, wherein t is the time (sec) necessary for each point on the surface of the photoconductive layer of the film 41 to pass through the ultraviolet light exposure zone, and a (cm) represents the distance between the ultraviolet light generator 44 and the film path. The image resolution is represented in accordance with the well known NBS (National Bureau of Standards). It is apparent from FIG. 5 that the image resolution increases as the amoung of the applied ultraviolet light increases from the zero amount to a certain amount from which the image resolution levels off. So, in the case of FIG. 5, about 0.7 or 0.8 is sufficient as the amount of the ultraviolet light in terms of $t/a^2$, and the amount more than that is practically unnecessary, although it is not undesired for the image resolution.

This invention will more readily be understood with reference to the following Examples, but these Examples are only intended to illustrate the invention, and are not to be construed to limit the scope of this invention.

EXAMPLE 1

10 grams of brominated poly-N-vinylcarbazole, 4 grams in total of Epicoat 828 (epoxy resin manufactured by Mitsubishi Yuka Co., Ltd., Japan) as a plasticizer and Adekacizer S-3 (chlorinated fatty acid ester manufactured by Asahi Denka Kogyo Co., Ltd., Japan) as a further plasticizer (the weight ratio of Epicoat 828 to Adekacizer S-3 being 5:1), 3 grams of Makrofol G (polycarbonate resin manufactured by BASF Co.) as a mechanical strength enhancer, 10 milligrams of 2-[3'-(3'-phenyl-benzopyranylidene) propenyl]-3-phenyl-benzopyrylium perchlorate as a dye-sensitizer, 90 grams of chlorobenzene as a solvent, and 30 grams of 1,2-dichloroethane as a further solvent were mixed to form an organic solution for a photoconductive layer. A toluene solution having 10 weight % of polyvinylacetate as an adhesive material was coated on an electrically conductive layer of CuI formed on a polyester film base to form an adhesive layer having a dry thickness of 4 microns. The above prepared organic solution for a photoconductive layer was coated on the thus formed adhesive layer to form a photoconductive layer having a dry thickness of 11 microns. Thereby, an electrophotograhic photosensitive plate was made. The thus made plate was divided into three pieces of electrophotographic photosensitive plate, first, second and third.

By using the first piece of the plate, the image resolution test was carried out as follows. An ultraviolet light was applied onto ten different portions of the surface of the photoconductive layer of the first piece of the plate for 1, 3, 5, 8, 10, 15, 20, 30 and 40 minutes, respectively, by using an ultraviolet light generator (mercury lamp UM-102 (110 V, 1.1 A) manufactured by Hitachi Seisakusho Co., Ltd., Japan) with the distance between the ultraviolet light generator and each portion of the photoconductive layer portion being kept at 40 cm. The thus treated electrophotographic photosensitive plate piece including the ultraviolet light non-applied portion was kept in the dark for one week. Thereafter, a negative charge having a potential of −1000 V was applied onto the surface of the photoconductive layer of the plate piece by means of a corona discharger. Then, on each of the ten portions and the ultraviolet light non-applied portion of the photoconductive layer surface, an image light reflected from a test pattern given by NBS (National Bureau of Standards) for image resolution testing was applied. On the thus treated plate piece, a toner comprising Isoper G (isoparaffinic hydrocarbon manufactured by Esso Standard Oil Co., Ltd.), a resin and positively charged carbon as toner pigments, was applied to form toner images. Thereby, image resolutions of the toner images on the eleven different portions of the photoconductive layer surface of the first piece plate could be measured, and the measured resolutions were plotted on a graph as a function of $t/a^2$ (t: ultraviolet light application time in terms of second, a: distance between the ultraviolet light generator and the photoconductive layer surface). FIG. 5 is the thus obtained graph. It is apparent from FIG. 5 that the image resolution of the ultraviolet light non-applied portion can be increased very much by the ultraviolet light application.

The thus made toner images were also subjected to an image density test. By using a micro-densitometer, the variation of image density with the variation of positions on the photoconductive layer surface of the first piece of plate from the light part of the image light to the dark part of the image light were measured as to ultraviolet light non-applied portion and the ultraviolet light 30 minutes applied portion. The curve 22 in FIG. 2 shows the thus measured variation of image density as to the ultraviolet light non-applied portion, and the curve 21 in FIG. 2 shows the thus measured variation of image density as to the ultraviolet light applied portion.

To confirm the effect of the ultraviolet light application more clearly, the same image resolution test as were performed above for the first piece of the electrophotographic photosensitive plate was carried out for the second piece of the plate, except that here an ultraviolet light filter (color glass filter UV 39 manufactured by Toshiba Kasei Kogyo Co., Ltd., Japan, which cuts light of wavelengths shorter than 390 mμ) was placed between the ultraviolet light generator and the photoconductive layer surface of the second piece of plate. As a result, there was substantially no difference in the image resolution among the many resultant toner images on the second piece plate.

To check whether the effect of the ultraviolet light application can be maintained for a long time, the third piece of the above made electrophotographic photosensitive plate was subjected to the following experiment. By shielding one half of the photoconductive layer surface of the third piece of plate, an ultraviolet light was applied to only the other half of the photoconductive layer surface of the third place in the same manner as was done for the above first piece of plate (the ultraviolet light application time being 30 minutes). The thus treated third piece of plate was kept in the dark for one year. Thereafter, the same toner image forming process as was performed for the first piece of plate was carried out for the thus treated third piece of plate, except that here an image pattern as shown in FIG. 3 was used for the image light. FIG. 3 shows the resultant toner images thus formed on the photoconductive layer surface of the third piece plate, wherein the portions 31 and 32 correspond to the ultraviolet light applied half portion and non-applied half portion of the third piece of plate respectively.

For checking the re-usability of the plate, the toner images formed on the third piece plate were wiped off with the aid of an organic solvent, and the same toner image forming process as done above (negative charging plus image light application plus toner application) was carried out. The thus formed toner images were quite similar to those of FIG. 3, and showed differences in image resolution or sharpness between the portions 31 and 32 as in FIG. 3.

EXAMPLE 2

An organic solution for a photoconductive layer was prepared in the same manner as done in Example 1, except that here poly-N-vinylcarbazole was used instead of brominated poly-N-vinylcarbazole, and 30 milligrams of 2-[(2'-phenyl-4'-benzopyranylidene)methyl]-3-phenylbenzopyrylium perchlorate was used instead of 10 milligrams of 2-[3'-(3'-phenylbenzopyranylidene) propenyl]-3-phenylbenzopyrylium perchlorate. A toluene solution having 10 weight % of polyvinylacetate as an adhesive material was coated on an electrically conductive layer of vacuum evaporated palladium formed on a polyester film base to form an adhesive layer having a dry thickness of 4 microns. The above prepared organic solution for a photoconductive layer was coated on three different portions of the surface of the thus formed adhesive layer to form three different photoconductive layers having dry thicknesses of 11, 13 and 14 microns, respectively, on the respective three portions thereof.

On only a half area of the photoconductive layer surface of each of the thus made three different photoconductive layers, an ultraviolet light was applied from the same ultraviolet light generator as used in Example 1 for 20 minutes, wherein the distance between the ultraviolet light and each of the photoconductive layers was kept at 50 cm. The thus treated electrophotographic plates were kept in the dark for one week. Thereafter, toner images were formed on all the three different photoconductive layers in the same manner as was done for the third piece of plate in Example 1.

As a result, the toner images formed on the ultraviolet light applied half area of each of the three different photoconductive layers were much higher as to the image sharpness than those on the other half area not having been subjected to the ultraviolet light application.

EXAMPLE 3

An organic solution for a photoconductive layer was prepared in the same manner as done in Example 1, except that here 30 milligrams of 2-[(2'-phenyl-4'-benzopyranylidene)methyl]-3-phenyl-4-(o-methoxyphenyl)benzopyrylium perchlorate and 70 milligrams of 2, 4-bis-p-methoxyphenyl-6-phenylpyrylium fluoborate were used instead of 10 milligrams of 2-[3'-(3'-phenylbenzopyranylidene)propenyl]-3-phenylbenzopyrylium perchlorate. The thus made organic solution was coated on an adhesive layer formed on an electrically conductive layer formed on a polyester film just as done in Example 1, so as to form a photoconductive layer having a dry thickness of 20 microns. Upon seven different portions of the thus made photoconductive layer, an ultraviolet light was applied from the same ultraviolet light generator in Example 1 by using the apparatus of FIG. 4 which fed the electrophotographic photosensitive plate (film) at a speed of 0.5 cm/sec, with the distance between the ultraviolet light generator and the respective seven different portions being kept at 4, 5, 6, 7, 8, 9 and 10 cm, respectively.

The thus treated electrophotographic photosensitive plate, including a photoconductive layer portion not having been subjected to the ultraviolet light application, was kept in the dark at 60° C. for 5 hours. Thereafter, toner images were formed on all the seven different photoconductive layer portions and the ultraviolet light non-applied portion in the same manner as was done for the third piece of plate in Example 1, except that here −5 kV negative charging was used instead of −1000 V negative charging. As a result, the toner images formed on all seven different photoconductive layer portions were much higher in image sharpness than those on the ultraviolet light non-applied portion.

EXAMPLE 4

An organic solution for a photoconductive layer was prepared in the same manner as was done in Example 1, except that here 25 milligrams of 2-[(2'-phenyl-4'-benzopyranylidene)methyl]-3-phenylbenzopyrylium perchlorate, 70 milligrams of 2, 3, 4-triphenyl-6-methylbenzopyrylium perchlorate and 5 milligrams of 2-[3'-(3'-phenyl-4-p-methoxyphenyl-2-benzothiopyranylidene)-propenyl]-3-phenyl-4-p-methoxyphenyl-benzothiopyrylium perchlorate were used instead of 10 milligrams of 2-[3'-(3'-phenylbenzopyranylidene)propenyl]-3-phenylbenzopyrylium perchlorate.

The thus made organic solution was coated on an adhesive layer formed on an electrically conductive layer formed on a polyester film just as was done in Example 1, so as to form a photoconductive layer having a dry thickness of 10 microns. Upon seven different portions of the thus made photoconductive layer, an ultraviolet light was applied from the same ultraviolet light generator in Example 1 by using the apparatus of FIG. 4 which fed the electrophotographic photosensitive plate (film) at a speed of 0.38 cm/sec, with the distances between the ultraviolet light generator and the respective seven different portions being kept at 4, 5, 6, 7, 8, 9 and 10 cm, respectively. Upon two other different portions of the above made photoconductive layer, the same ultraviolet light was applied by using the apparatus of FIG. 4 which fed the electrophotographic photosensitive plate at a speed of 1.25 cm/sec. with the distances between the ultraviolet light generator and the respective two portions being kept at 5 and 8.5 cm, respectively.

The thus treated electrophotographic photosensitive plate including a photoconductive layer portion not having been subjected to the ultraviolet light application was kept in the dark for one week. Thereafter, toner images were formed on all the nine different photoconductive layer portions and the ultraviolet light non-applied portion in the same manner as was done for the third piece of plate in Example 1, except that here −5 kV negative charging was used instead of −1000 V negative charging. As a result, the toner images formed on all the nine different photoconductive layer portions were much higher than those on the ultraviolet light non-applied portion.

EXAMPLE 5

15 grams of poly-N-vinylcarbazole, 10 milligrams of 2-[3'-(3'-phenyl-benzopyranylidene)propenyl]-3-phenyl-benzopyrylium perchlorate as a dye-sensitizer, 90 grams of chlorobenzene as a solvent, and 30 grams of 1, 2-dichloroethane as a further solvent were mixed to form an organic solution for a photoconductive layer. The thus prepared organic solution was coated on an electrically conductive layer of $SnO_2$ formed on a glass plate to form a photoconductive layer having a dry thickness of 15 microns. Thus, an electrophotographic photosensitive plate was made. An ultraviolet light was applied to only a half area of the photoconductive layer of the thus made electrophotographic photosensitive plate for 20 minutes by using the same ultraviolet light generator as used in Example 1, with the distance between the photoconductive layer and the ultraviolet light generator being 45 cm.

The thus treated electrophotographic photosensitive plate, the photoconductive layer of which has the ultraviolet light applied area and non-applied area, was kept in the dark for one week. Thereafter, a negative charge having a potential of −2000 V was applied onto the surface of the photoconductive layer by means of a corona discharger. Then, on the thus charged photoconductive layer surface, an image light reflected from an original was applied. On the thus treated electrophotographic photosensitive plate, a toner comprising Isoper H (isoparaffinic hydrocarbon manufactured by Esso Standard Oil Co., Ltd.), a resin and positively charged phthalocyanine blue as toner pigments, was applied to form toner images. The toner images thus formed on the ultraviolet light applied area were much higher as to the image sharpness than those on the ultraviolet light non-applied area of the photoconductive layer surface.

EXAMPLE 6

The procedure of Example 5 was repeated, except that here brominated poly-N-vinylcarbazole was used instead of poly-N-vinylcarbazole, 30 milligrams of 2-[(2'-phenyl-4'-benzopyranylidene) methyl]-3-phenylbenzopyrylium perchlorate was used instead of 10 milligrams of 2-[3'-(3'-phenyl-benzopyranylidene)propenyl]-3-phenylbenzopyrylium perchlorate, and hansa yellow was used instead of phthalocyanine blue. Thereby, much sharper toner image were formed on the ultraviolet light applied area than those on the ultraviolet light non-applied area of the here made photoconductive layer.

What is claimed is:

1. A method for permanently improving image sharpness of an electrophotographic photosensitive plate comprising an electrically conductive layer and a dye-sensitized photoconductive layer to be negatively charged in an electrophotographic process, the method comprising applying an ultraviolet light onto the surface of said dye-sensitized photoconductive layer before being negatively charged, for a time sufficient to cause dye sensitizers at or near the surface of said photoconductive layer to permanently lose their photosensitizing function.

2. A method according to claim 1, wherein said dye-sensitized photoconductive layer has polyvinylcarbazole or a polyvinylcarbazole derivative as a photoconductor.

3. A method according to claim 1, wherein said dye-sensitized photoconductive layer has as a photoconductor, one member selected from the group consisting of poly-N-vinylcarbazole and brominated poly-N-vinylcarbazole.

4. A method according to claim 1, wherein said dye-sensitized photoconductive layer includes, as a dye-sensitizer, one member selected from the group consisting of benzopyrylium salts, benzothiopyrylium salts, pyrylium salts, thiopyrylium salts, substituted benzopyrylium salts, substituted benzothiopyrylium salts, substituted pyrylium salts and substituted thiopyrylium salts.

5. A method according to claim 1, wherein said dye-sensitized photoconductive layer includes, as a dye-sensitizer, one member selected from the group consisting of 2-[3'-(3'-phenyl-benzopyranylidene)propenyl]-3-phenylbenzopyrylium perchlorate, 2-[(2'-phenyl-4'-benzopyranylidene) methyl]-3-phenylbenzopyrylium perchlorate, 2-[2'-phenyl-4'-benzopyranylidene)methyl]-3-phenyl-4-(o-methoxyphenyl)benzopyrylium perchlorate, 2,4-bis-p-methoxyphenyl-6-phenylpyrylium fluoborate, 2-[(2'-phenyl-4'-benzopyranylidene)methyl]-3-phenyl-benzopyrylium perchlorate, 2,3,4-triphenyl-6-methylbenzopyrylium perchlorate and 2-[3'-(3'-phenyl-4-methoxyphenyl-2-benzothiopyranylidene)propenyl]-3-phenyl-4-p-methoxyphenyl-benzothiopyrylium perchlorate.

6. The method according to claim 1, wherein said negative charge application is carried out after said photosensitive plate is kept at room temperature for one week after the ultraviolet light application.

7. The method according to claim 1, wherein said negative charge application is carried out after said photosensitive plate is kept at 60° C. for 5 hours after the ultraviolet light application.

* * * * *